US008561704B2

(12) United States Patent
Teale et al.

(10) Patent No.: US 8,561,704 B2
(45) Date of Patent: Oct. 22, 2013

(54) FLOW ENERGY DISSIPATION FOR DOWNHOLE INJECTION FLOW CONTROL DEVICES

(75) Inventors: David W. Teale, Spring, TX (US); Gireesh K. Bhat, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 304 days.

(21) Appl. No.: 12/824,470

(22) Filed: Jun. 28, 2010

(65) Prior Publication Data

US 2011/0315388 A1 Dec. 29, 2011

(51) Int. Cl.
*E21B 34/06* (2006.01)

(52) U.S. Cl.
USPC ..... 166/334.4; 166/169; 166/316; 166/386

(58) Field of Classification Search
USPC ..... 166/169, 316, 386, 334.4
See application file for complete search history.

(56) References Cited

U.S. PATENT DOCUMENTS

| | | | | |
|---|---|---|---|---|
| 2,765,146 | A * | 10/1956 | Williams, Jr. | 175/317 |
| 4,064,938 | A * | 12/1977 | Fast | 166/236 |
| 5,636,691 | A | 6/1997 | Hendrickson et al. | |
| 5,881,809 | A * | 3/1999 | Gillespie et al. | 166/233 |
| 6,253,853 | B1 * | 7/2001 | George | 166/334.4 |
| 6,491,097 | B1 | 12/2002 | Oneal et al. | |
| 6,622,794 | B2 * | 9/2003 | Zisk, Jr. | 166/373 |
| 7,114,582 | B2 * | 10/2006 | Eppink et al. | 175/61 |
| 7,451,825 | B2 * | 11/2008 | Jonas | 166/373 |
| 7,455,115 | B2 * | 11/2008 | Loretz et al. | 166/373 |
| 7,712,540 | B2 * | 5/2010 | Loretz et al. | 166/373 |
| 7,762,341 | B2 * | 7/2010 | Hammer | 166/370 |
| 7,819,187 | B2 * | 10/2010 | Graham et al. | 166/245 |
| 7,918,275 | B2 * | 4/2011 | Clem | 166/250.15 |
| 8,069,921 | B2 * | 12/2011 | Garcia et al. | 166/278 |
| 8,291,976 | B2 * | 10/2012 | Schultz et al. | 166/272.3 |
| 2004/0112645 | A1 * | 6/2004 | Eppink et al. | 175/61 |
| 2006/0175061 | A1 * | 8/2006 | Crichlow | 166/302 |
| 2006/0213671 | A1 * | 9/2006 | Li et al. | 166/387 |
| 2007/0246223 | A1 * | 10/2007 | Zielinska et al. | 166/373 |
| 2007/0246226 | A1 * | 10/2007 | Macias et al. | 166/386 |
| 2007/0272408 | A1 * | 11/2007 | Zazovsky et al. | 166/278 |
| 2008/0149323 | A1 * | 6/2008 | O'Malley et al. | 166/53 |
| 2008/0236843 | A1 * | 10/2008 | Scott et al. | 166/386 |

(Continued)

OTHER PUBLICATIONS

Well Dynamics; VLV, HVC, 4.5 Assy, Shroud; Drawing No. 311066-23-01; dated Jan. 12, 2007; 1 page.

(Continued)

*Primary Examiner* — Jennifer H Gay
(74) *Attorney, Agent, or Firm* — Smith IP Services, P.C.

(57) ABSTRACT

A well system can include a flow control device which regulates flow of a fluid from an interior of the device outwardly through an exit port, and a deflector which outwardly overlies the exit port and provides fluid communication between the exit port and an annulus formed radially between the deflector and a wellbore lining. The deflector can diffuse the flow of the fluid prior to impingement on the wellbore lining. A flow control assembly can include a flow control device which regulates flow of a fluid from an interior of the device outwardly through an exit port, and a deflector which outwardly overlies the exit port, the deflector including at least one opening, and the opening being circumferentially offset relative to the exit port. A form of an interior surface of the deflector and/or an exterior surface of the flow control device can diffuse the flow of the fluid.

20 Claims, 6 Drawing Sheets

(56) References Cited

U.S. PATENT DOCUMENTS

| | | | | |
|---|---|---|---|---|
| 2009/0020292 | A1* | 1/2009 | Loretz et al. | 166/373 |
| 2009/0038792 | A1* | 2/2009 | Graham et al. | 166/245 |
| 2009/0133869 | A1* | 5/2009 | Clem | 166/250.15 |
| 2009/0205834 | A1* | 8/2009 | Garcia et al. | 166/373 |
| 2010/0243253 | A1* | 9/2010 | Surjaatmadja et al. | 166/298 |
| 2010/0294495 | A1* | 11/2010 | Clarkson et al. | 166/278 |
| 2011/0079396 | A1* | 4/2011 | Russell et al. | 166/369 |
| 2011/0139453 | A1* | 6/2011 | Schultz et al. | 166/272.3 |
| 2011/0315388 | A1* | 12/2011 | Teale et al. | 166/316 |

OTHER PUBLICATIONS

Well Dynamics; Shroud Adapter; Drawing No. 311870-10-01; dated Jan. 11, 2007, 1 page.
Well Dynamics; VLV, HVC, INTGRTD; Drawing No. 312206-26-01; dated Jun. 12, 2007, 1 page.
Well Dynamics; Deflector; Drawing No. 313966-03-01; dated Jun. 6, 2007; 1 page.

* cited by examiner

FLOW ENERGY DISSIPATION FOR DOWNHOLE INJECTION FLOW CONTROL DEVICES

BACKGROUND

This disclosure relates generally to equipment utilized and operations performed in conjunction with a subterranean well and, in an example described below, more particularly provides flow energy dissipation for downhole injection flow control devices.

A flow control device (e.g., valves, chokes, etc.) can be used to regulate flow of an injected fluid in well operations, such as steam injection, water injection, gas injection, etc. Unfortunately, the injected fluid can be erosive to the flow control device and any liner, casing or other wellbore lining which surrounds the flow control device.

In the past, a deflector has been used to redirect the injected fluid (which exits the flow control device in a radial direction), so that it flows in a longitudinal direction relative to the wellbore lining. Unfortunately, although this provides some protection to the wellbore lining, it contains the injected fluid flow adjacent to the flow control device, thereby causing erosion of the flow control device.

Therefore, it will be appreciated that improvements are needed in the art of protecting downhole flow control devices and wellbore linings from erosive flow.

SUMMARY

In the disclosure below, a flow control assembly is provided which brings improvements to the art of protecting downhole flow control devices and wellbore linings. One example is described below in which a deflector is used on a flow control device to dissipate energy in fluid flow from the flow control device. Another example is described below in which the deflector operates to decrease vibration resulting from the fluid flow.

In one aspect, the present disclosure provides to the art a well system which can include a flow control device which regulates flow of a fluid from an interior of the flow control device outwardly through at least one exit port. A deflector which outwardly overlies the exit port provides fluid communication between the exit port and an annulus formed radially between the deflector and a wellbore lining. The deflector diffuses the flow of the fluid prior to impingement on the wellbore lining.

In another aspect, a flow control assembly for use in a subterranean well is provided. The flow control assembly can include a flow control device which regulates flow of a fluid from an interior of the flow control device outwardly through at least one exit port, and a deflector which outwardly overlies the exit port. The deflector includes at least one opening, with the opening being circumferentially offset relative to the exit port.

In yet another aspect, a form of an interior surface of the deflector and/or an exterior surface of the flow control device can diffuse the flow of the fluid. The form may comprise, for example, at least one of a dimple, ridge, surface roughness, recess, conical projection and helical structure.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
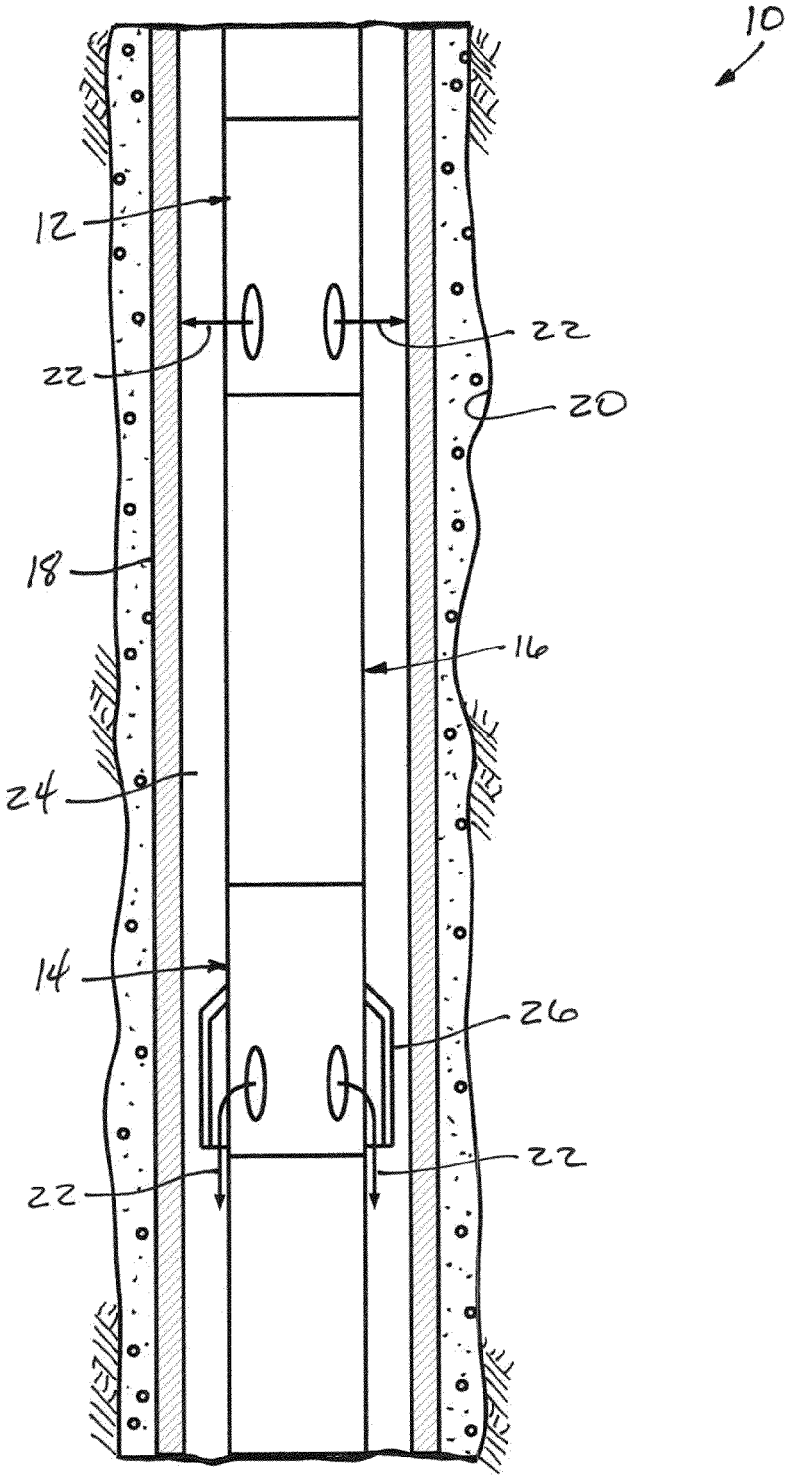
FIG. 1 (PRIOR ART)
FIG. 1 is a schematic partially cross-sectional view of prior art flow control arrangements in a well system.

Representatively illustrated in FIG. 1 is a well system 10 which could benefit from the principles of this disclosure. FIG. 1 is marked as "Prior Art" to indicate that the types of flow control devices depicted in FIG. 1 are known in the art, but the combination of flow control devices depicted in FIG. 1 would likely not have been used in the prior art.

As illustrated in FIG. 1, flow control devices 12, 14 are interconnected in a tubular string 16. The tubular string 16 is installed in a wellbore lining 18 which serves as a protective lining for a wellbore 20. The wellbore lining 18 could be of the type known to those skilled in the art as casing, liner, tubing, etc.

The flow control devices 12, 14 are used to control flow of fluid 22 from an interior of the tubular string 16 to an annulus 24 formed radially between the tubular string and the wellbore lining 18. Thus, the flow control devices 12, 14 could be of the type known to those skilled in the art as injection valves or chokes, and may be used to control injection of gas, steam, water and/or other fluids into a well.

Note that the fluid 22 exits the flow control device 12 and impinges directly on the wellbore lining 18. This can lead to undesirable erosion of the wellbore lining 18, especially if the fluid 22 includes any abrasive particles. However, even if there are no abrasive particles in the fluid 22, it can still erode the wellbore lining 18 if it exits the flow control device 12 at a sufficiently great flow rate.

The flow control device 14, on the other hand, is provided with a shield 26 for protecting the wellbore lining 18. Unfortunately, studies conducted by the present inventors have shown that the shield 26 contributes to erosion of the flow control device 14 itself, due apparently to swirling of the fluid 22 and vortices created as the fluid exits the flow control device and impinges on the shield.

Furthermore, in both of the flow control devices 12, 14, vibration can be produced by the turbulent flow of the fluid 22 as it impinges on the wellbore lining 18 or shield 26, as it swirls within the shield, etc. This vibration is harmful to the flow control devices 12, 14, control lines connected thereto, etc., over long periods of time.

Figure 2:
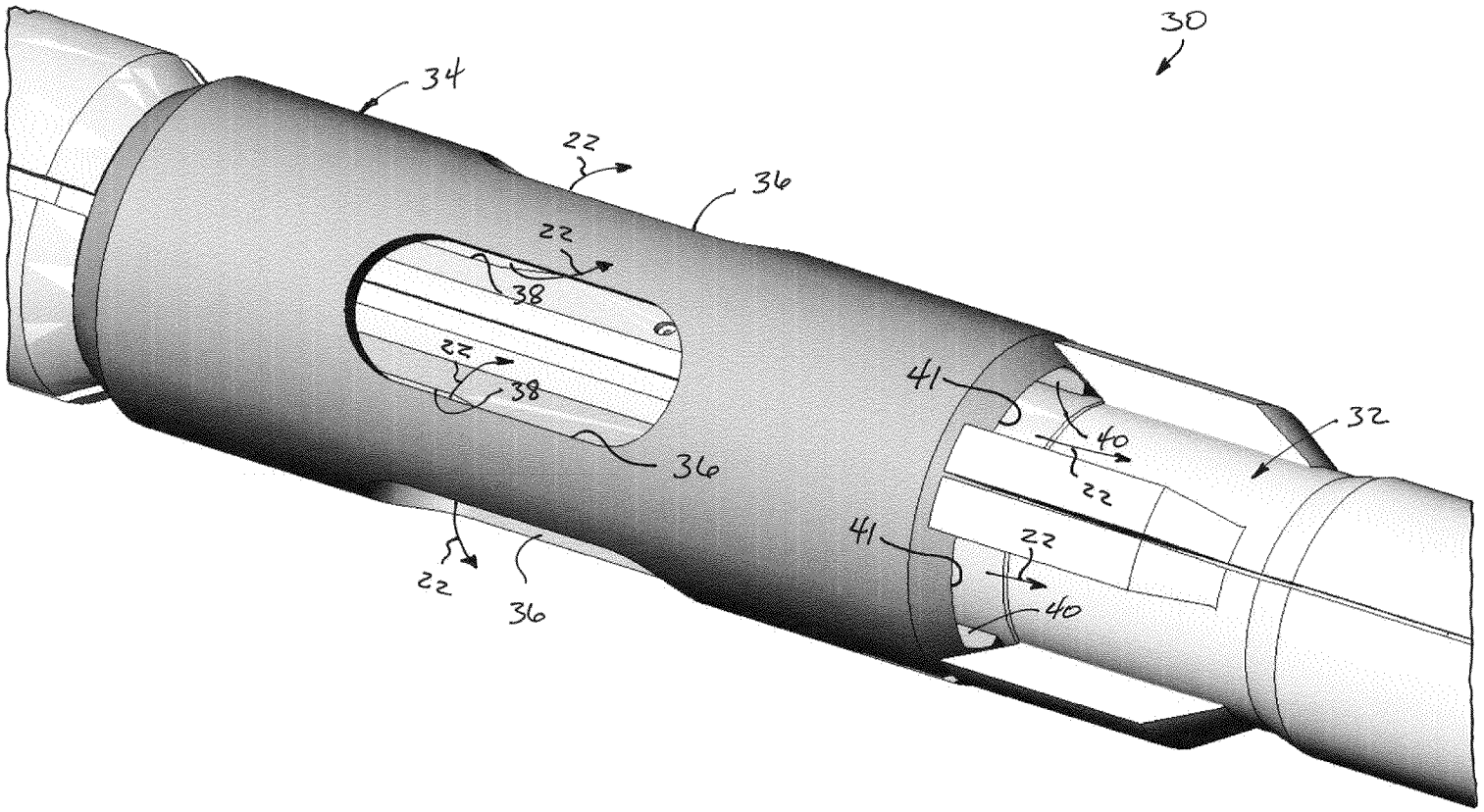
FIG. 2 is an enlarged scale schematic perspective view of a flow control assembly which may be used in the well system of FIG. 1, the flow control assembly embodying principles of this disclosure.

Referring additionally now to FIG. 2, a flow control assembly 30 which embodies principles of this disclosure is representatively illustrated. The flow control assembly 30 may be used in place of the flow control device 12 and/or flow control device 14 and shield 26 in the well system 10. Of course, the flow control assembly 30 may also be used in other well systems without departing from the principles of this disclosure.

The flow control assembly 30 as depicted in FIG. 2 includes a flow control device 32 and a deflector 34. The deflector 34 includes openings 36 which are circumferentially offset relative to exit ports 38 of the flow control device 32.

Figure 3:
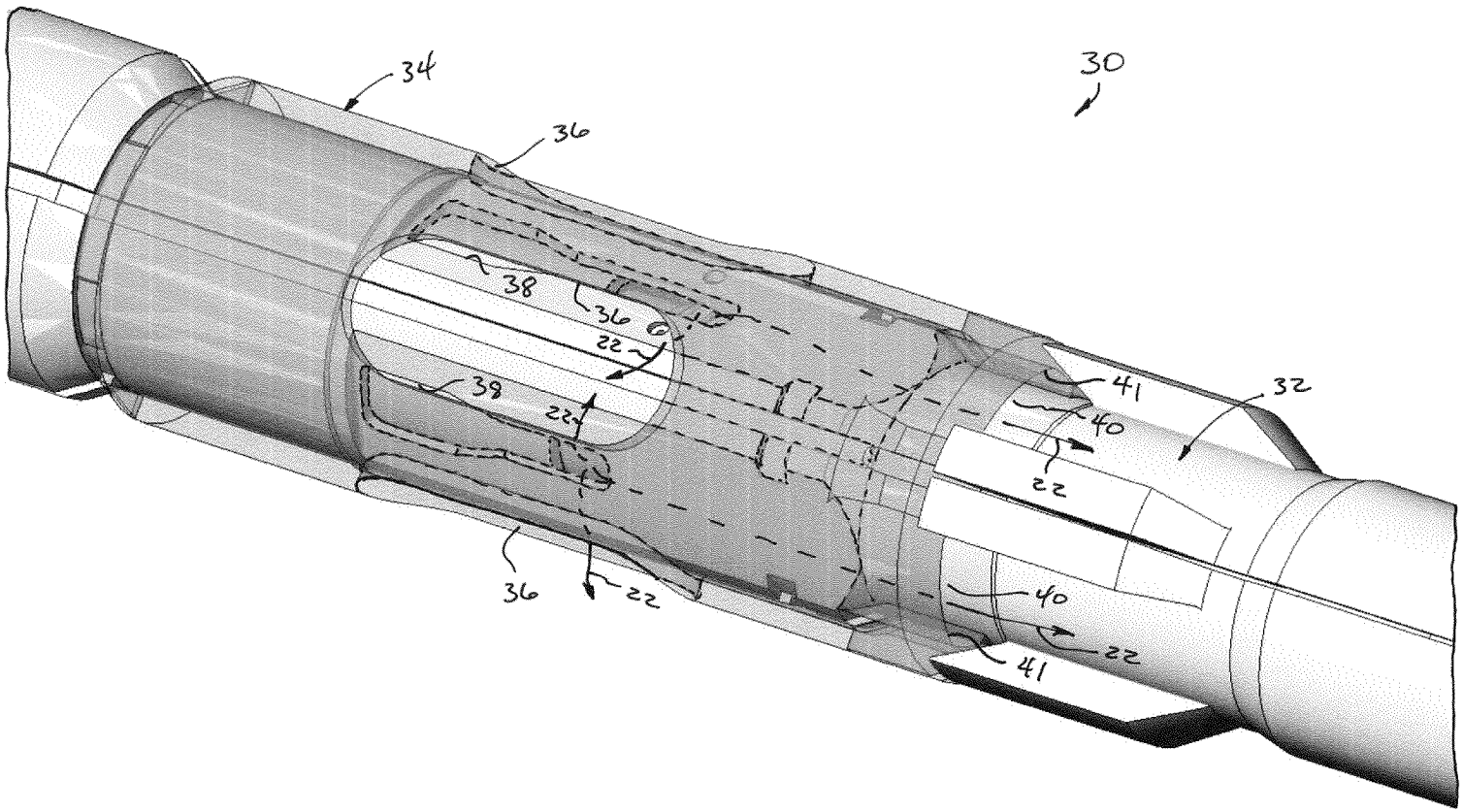
FIG. 3 is a schematic perspective view of the flow control assembly, in which hidden features of a flow control device are shown in dashed lines.

Referring additionally now to FIG. 3, the flow control device 32 within the deflector 34 is shown in dashed lines. In this view, the manner in which the openings 36 are circumferentially offset relative to the exit ports 38 can be more readily seen.

Note that the openings 36 in the deflector 34 example of FIGS. 2 & 3 are configured as longitudinally elongated slots. The slots provide sufficient flow area for diffusing the flow of the fluid 22 as it exits the exit ports 38. The slots can vary in position, size, shape, number, orientation, etc.

By diffusing the flow of the fluid 22, swirling between the deflector 34 and the flow control device 32 is reduced. At the same time, the openings 36 provide for flow of the fluid 22 between the exit ports 38 and the annulus 24, without direct impingement of the fluid on the wellbore lining 18. Any shape, number, position, etc. of the openings 36 may be used.

Note, also, that there is some circumferential overlap between the openings 36 and the exit ports 38, as depicted in FIGS. 2 & 3. However, in other examples, there may be no such overlap. In addition to the openings 36, the fluid 22 can flow to the annulus 24 via an annular space 40 radially between a lower end of the deflector 34 and the flow control device 32, similar to the flow control device 14 and shield 26 depicted in FIG. 1.

The annular space 40 opens to the annulus 24 at openings 41. The openings 41 allow the fluid 22 to flow longitudinally from the annular space 40 to the annulus 24. Thus, the flow from the exit ports 38 is divided between the openings 36 and the openings 41.

The deflector 34 is preferably made of a durable, erosion resistant material (such as carbide, etc.) and/or the deflector may be provided with erosion resistant coatings.

Figure 4:
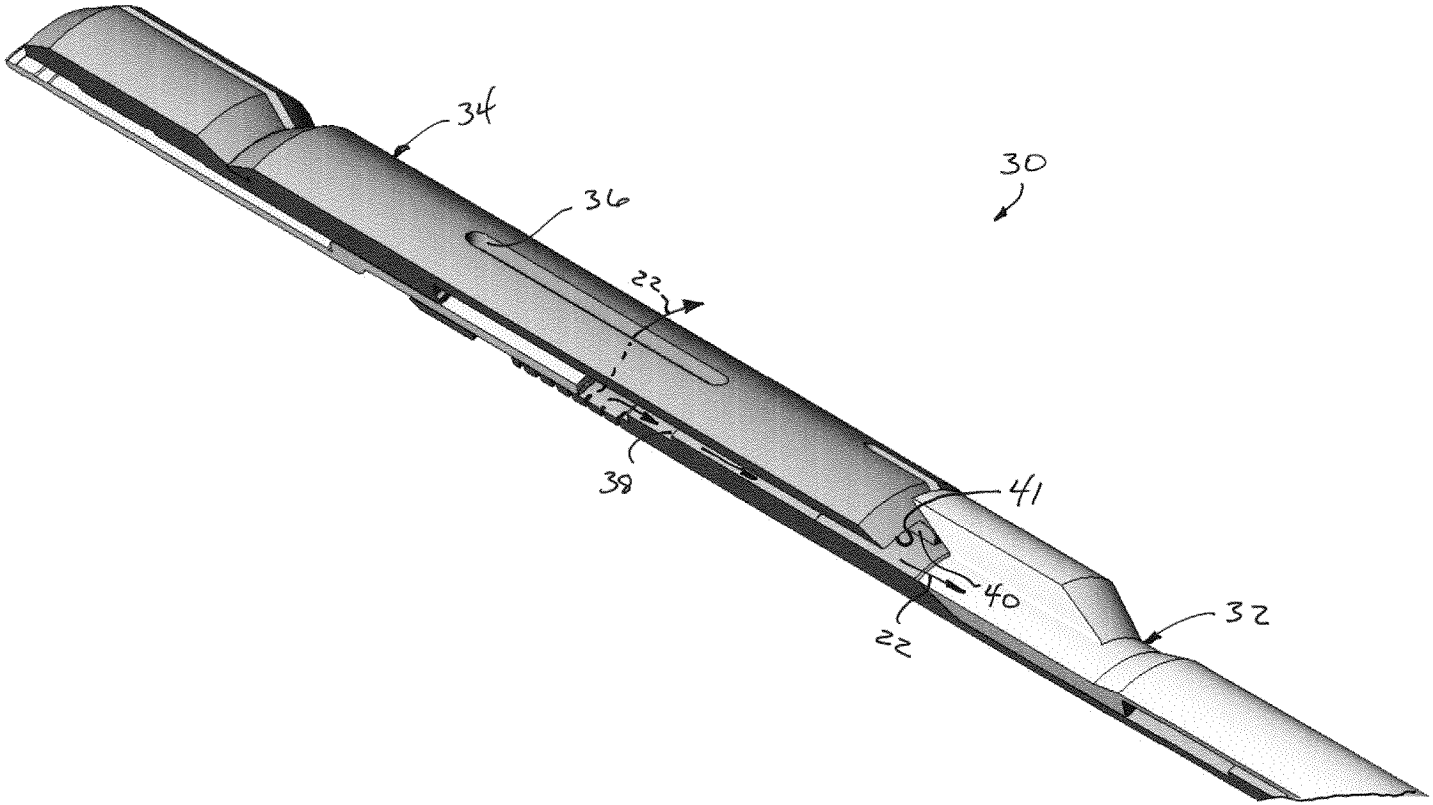
FIG. 4 is a schematic perspective view of another configuration of the flow control assembly.

Referring additionally now to FIG. 4, another configuration of the flow control assembly 30 is representatively illustrated. In this configuration, the openings 36 are in the form of narrow slots. Any shape, number, position, etc. of the slots may be used. Additional slots may be used, for example, in order to provide sufficient flow area for diffusing the flow of the fluid 22 through the openings 36.

Figure 5:
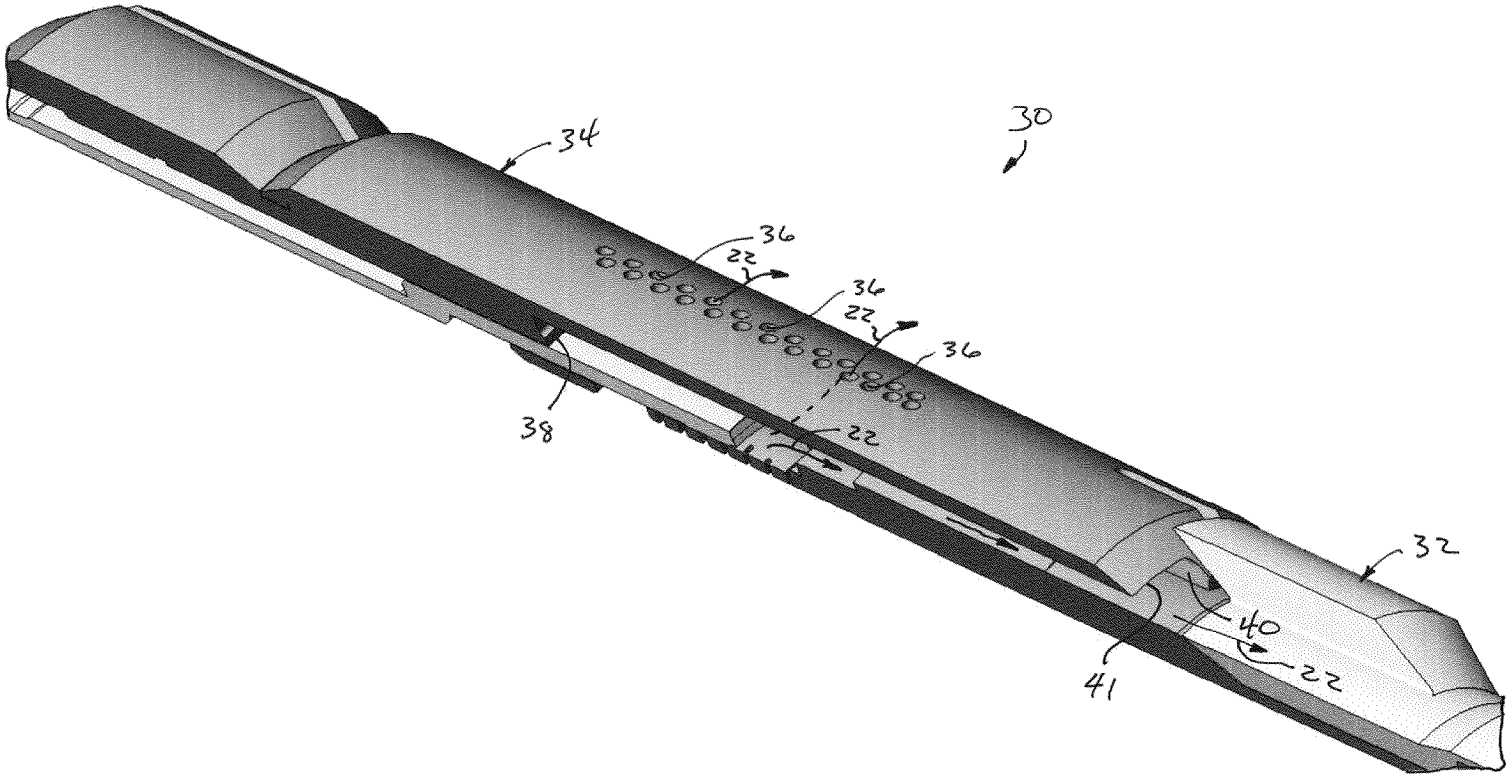
FIG. 5 is a schematic perspective view of yet another configuration of the flow control assembly.

Referring additionally now to FIG. 5, yet another configuration of the flow control assembly 30 is representatively illustrated. In this configuration, the openings 36 are in the form of many holes. Again, the number and arrangement of the holes can be varied as needed to desirably diffuse the flow of the fluid 22. Any shape, number, position, etc. of the holes may be used. Restriction of flow through the holes can also function to dissipate flow energy.

Referring additionally now to FIGS. 6A-F, various forms of surfaces on the interior of the deflector 34 and/or on the exterior of the flow control device 32 are representatively illustrated. These and/or other surfaces can be used to dissipate energy in the flow of the fluid 22, to minimize vibration and/or to enhance a fluid boundary layer adjacent the surfaces and thereby minimize erosion.

Figure 6A:
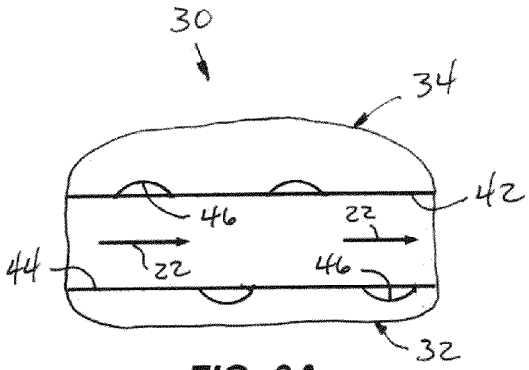
FIGS. 6A-F are schematic cross-sectional views of a deflector and the flow control device, showing various forms of surfaces on those components.

In FIG. 6A, an interior surface 42 of the deflector 34 and/or an exterior surface 44 of the flow control device 32 have dimples 46 formed thereon. The dimples 46 aid in enhancing the fluid boundary layer adjacent the surfaces 42, 44, thereby reducing erosion of these surfaces.

Figure 6B:
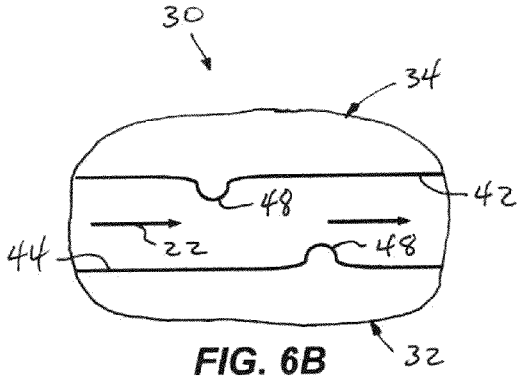

In FIG. 6B, the interior surface 42 of the deflector 34 and/or the exterior surface 44 of the flow control device 32 have ridges 48 formed thereon. The ridges 48 aid in dissipating the flow energy of the fluid 22 as it flows over the ridges.

Figure 6C:
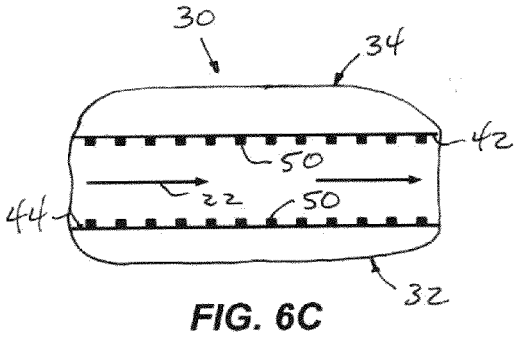

In FIG. 6C, the interior surface 42 of the deflector 34 and/or the exterior surface 44 of the flow control device 32 have a surface roughness 50. The surface roughness 50 enhances the fluid boundary layer adjacent the surfaces 42, 44.

Figure 6D:
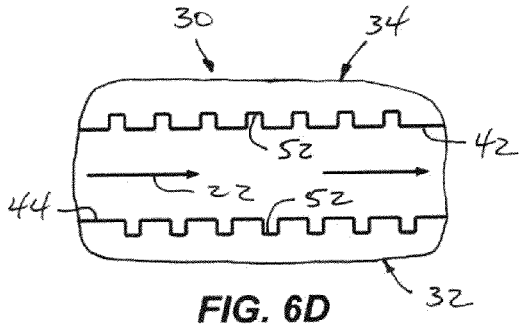

In FIG. 6D, the interior surface 42 of the deflector 34 and/or the exterior surface 44 of the flow control device 32 have recesses 52 formed thereon. The recesses 52 aid in dissipating energy in the flow of the fluid 22.

Figure 6E:
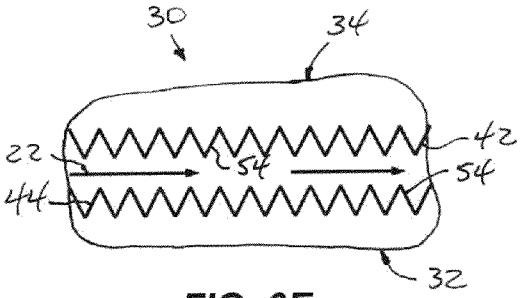

In FIG. 6E, the interior surface 42 of the deflector 34 and/or the exterior surface 44 of the flow control device 32 have conical projections 54 formed thereon. The conical projections 54 aid in reducing vibration, and in dissipating energy in the flow of the fluid 22.

Figure 6F:
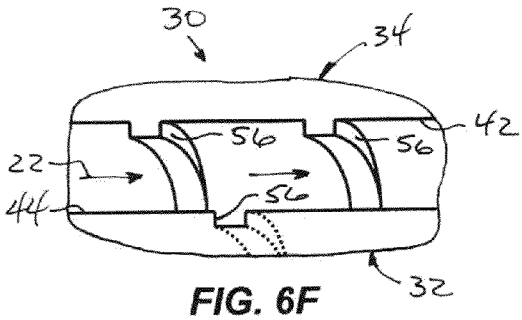

In FIG. 6F, the interior surface 42 of the deflector 34 and/or the exterior surface 44 of the flow control device 32 have helical structures 56 formed thereon. The helical structures 56 on the interior surface 42 are depicted as projections, and the helical structures on the exterior surface 44 are depicted as recesses, but either form may be used on either surface, without departing from the principles of this disclosure.

The configurations depicted in FIGS. 6A-F are merely examples of the wide variety of possible surface forms which may be used in the flow control assembly 30. Thus, it should be clearly understood that the principles of this disclosure are not limited at all to the surface forms illustrated in FIGS. 6A-F.

It may now be fully appreciated that the above disclosure provides several advancements to the art of controlling fluid flow in a well. The flow control assembly 30 described above protects both the flow control device 32 and the wellbore lining 18 from erosive damage by diffusing flow of the fluid 22 and decreasing a flow energy of the fluid.

There is a reduction of flow induced vibration at the flow control assembly 30. Bypassed control lines and the overall tool string benefit from redirecting flow and reducing flow energy.

There is a diffusion of flow energy. This diffusion can occur proximate the exit ports 38, away from the exit ports, upstream or downstream. Flow energy can be diffused in multiple stages.

Surface geometry can protect against erosion by setting up a boundary layer of fluid 22 that provides protection against impingement and other flow induced effects.

Some of the benefits which can be obtained from utilization of the principles of this disclosure include: increased tool life, increased operating envelope (e.g., higher flow rates and/or pressure drops with less impact on tool life, etc.), increased flow area for a given dimensional design envelope, increased resistance to erosion and related effects, higher tolerance for entrained debris and particle loading and/or better fluid management (e.g., control of fluid flow to eliminate swirl patterns, impingement, erosion patterns, etc.).

The above disclosure describes a well system 10 which can include a flow control device 32 that regulates flow of a fluid 22 from an interior of the flow control device 32 outwardly through at least one exit port 38. A deflector 34 outwardly overlies the exit port 38 and provides fluid communication between the exit port 38 and an annulus 24 formed radially between the deflector 34 and a wellbore lining 18. The deflector 34 diffuses the flow of the fluid 22 prior to impingement on the wellbore lining 18.

The deflector 34 may include at least one opening 36. The fluid 22 can flow into the annulus 24 via the opening 36. Preferably, the opening 36 is circumferentially offset relative to the exit port 38.

The opening 36 may comprise a longitudinally elongated slot or a plurality of openings. The fluid 22 may change direction when it flows to the opening 36 from an annular space 40 between the flow control device 32 and the deflector 34.

A form of an interior surface 42 of the deflector 34 and/or an exterior surface 44 of the flow control device 32 may diffuse the flow of the fluid 22. The form may comprise at least one of a dimple 46, ridge 48, surface roughness 50, recess 52, conical projection 54 and helical structure 56.

A flow control assembly 30 for use in a subterranean well is also described by the above disclosure. The flow control assembly 30 may include a flow control device 32 which regulates flow of a fluid 22 from an interior of the flow control device 32 outwardly through at least one exit port 38, and a deflector 34 which outwardly overlies the exit port 38. The deflector 34 may include at least one opening 36, with the opening being circumferentially offset relative to the exit port 38.

The opening 36 in the deflector 34 can, in some examples, direct the fluid 22 to flow radially outward relative to the deflector 34.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

In the above description of the representative examples of the disclosure, directional terms, such as "above," "below," "upper," "lower," etc., are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A well system, comprising:

a flow control device which regulates flow of a fluid from an interior of the flow control device outwardly through at least one exit port; and a deflector which outwardly overlies the exit port and provides fluid communication between the exit port and an annulus formed radially between the deflector and a wellbore lining selected from the group consisting of a casing, a liner, and a tubing, the deflector including at least one opening through a wall of the deflector and through which at least a portion of the fluid flows, whereby the deflector diffuses the flow of the fluid prior to impingement of the fluid on the wellbore lining.

2. The well system of claim 1, wherein the fluid flows into the annulus via the opening, and wherein the opening is circumferentially offset relative to the exit port.

3. The well system of claim 1, wherein the opening comprises a longitudinally elongated slot.

4. The well system of claim 1, wherein the opening comprises a plurality of openings.

5. The well system of claim 1, wherein the fluid changes direction when it flows to the opening from an annular space between the flow control device and the deflector.

6. The well system of claim 1, wherein a form of at least one of an interior surface of the deflector and an exterior surface of the flow control device diffuses the flow of the fluid.

7. The well system of claim 6, wherein the form comprises at least one form selected from the group consisting of a dimple, a ridge, a surface roughness, a recess, a conical projection and a helical structure.

8. A flow control assembly for use in a subterranean well, the flow control assembly comprising:

a flow control device which regulates flow of a fluid from an interior of the flow control device outwardly through at least one exit port; and a deflector which outwardly overlies the flow control device, the deflector including at least one opening through a wall of the deflector, the opening being circumferentially offset relative to the exit port, wherein a first portion of the fluid exits the flow control assembly via the opening, and wherein a second portion of the fluid exits the flow control assembly via an annular space between the flow control device and an end of the deflector.

9. The flow control assembly of claim 8, wherein the opening comprises a longitudinally elongated slot.

10. The flow control assembly of claim 8, wherein the opening comprises a plurality of openings.

11. The flow control assembly of claim 8, wherein the first portion of the fluid must change direction.

12. The flow control assembly of claim 8, wherein a form of at least one of an interior surface of the deflector and an exterior surface of the flow control device diffuses the flow of the fluid.

13. The flow control assembly of claim 12, wherein the form comprises at least one form selected from the group consisting of a dimple, a ridge, a surface roughness, a recess, a conical projection and a helical structure.

14. A flow control assembly for use in a subterranean well, the flow control assembly comprising:

a flow control device which regulates flow of a fluid from an interior of the flow control device outwardly through at least one exit port; and a deflector which outwardly overlies the exit port, the deflector including at least one opening through a wall of the deflector and through which at least a portion of the fluid flows, wherein a form of at least one of an interior surface of the deflector and an exterior surface of the flow control device enhances a fluid boundary layer adjacent the respective surface, thereby reducing erosion of the flow control assembly.

15. The flow control assembly of claim 14, wherein the form comprises at least one form selected from the group consisting of a dimple, a ridge, a surface roughness, a recess, a conical projection and a helical structure.

16. The flow control assembly of claim 14, wherein the opening is circumferentially offset relative to the exit port.

17. The flow control assembly of claim 14, wherein the opening comprises a longitudinally elongated slot.

18. The flow control assembly of claim 14, wherein the opening comprises a plurality of openings.

19. The flow control assembly of claim 14, wherein the fluid which flows to the opening from an annular space between the flow control device and the deflector must change direction.

20. The flow control assembly of claim 14, wherein the opening directs the fluid to flow radially outward relative to the deflector.

* * * * *